United States Patent [19]

Leibin et al.

[11] 4,039,796

[45] Aug. 2, 1977

[54] MICROWAVE OVEN HAVING IMPROVED CONVEYING MEANS

[76] Inventors: Jury Veniaminovich Leibin, ulitsa Raevskogo, 3, kv. 36, Leningrad; Samuil Veniaminovich Nekrutman, Lomonosovsky prospekt, 19, kv. 264, Moscow; Alexandr Nikolaevich Vyshelessky, Petrovsko-Razumovsky proezd, 7, kv. 28, Moscow; Iosif Alexandrovich Rogov, ulitsa Vostrukhina, 7, kv. 80, Moscow; Lazar Iosifovich Kishinevsky, prospekt 50-letia Oktyabrya, 81, kv. 32; Anatoly Pavlovich Pidenko, prospekt 50-letia Oktyabrya, 81, kv. 31, both of Saratov, all of U.S.S.R.

[21] Appl. No.: 651,397

[22] Filed: Jan. 22, 1976

Related U.S. Application Data

[63] Continuation of Ser. No. 484,221, June 28, 1974, abandoned.

[51] Int. Cl.[2] ..... H05B 9/06

[52] U.S. Cl. ..... 219/10.55 A; 99/443 R; 219/10.55 D

[58] Field of Search ..... 219/10.55 A, 10.55 R, 219/10.55 F, 10.55 D, 10.55 E; 99/451, 443, 427; 126/338, 41 A, 41 B, 41 C

[56] References Cited

U.S. PATENT DOCUMENTS

| | | | |
|---|---|---|---|
| 2,920,177 | 1/1960 | Brane | 126/41 A |
| 3,151,230 | 9/1964 | Britton | 219/10.55 A |
| 3,404,620 | 10/1968 | Smith | 219/10.55 A |
| 3,531,871 | 10/1970 | Sahara | 219/10.55 R |
| 3,566,066 | 2/1971 | Borthwick | 219/10.55 R |
| 3,614,924 | 10/1971 | Hickey | 99/443 X |
| 3,676,058 | 7/1972 | Gray | 219/10.55 R |

*Primary Examiner*—Arthur T. Grimley

[57] ABSTRACT

A microwave-frequency oven intended primarily for heating food-stuffs in which a microwave-frequency electromagnetic oscillator is connected through the slot-type exciter to the chamber formed as a body of revolution, with the chamber being provided with a loading-unloading opening; a rotor is installed inside said chamber in coaxial relationship therewith, with the shaft of the rotor carrying radially and equidistantly spaced blades provided with seals to prevent dissipation of microwave-frequency energy; said blades correspond to the shape of the housing of the chamber through which they move, and divide the chamber into isolated compartments, with shelves of dielectric material for placing products thereupon being positioned between the lower and upper edges of the blades perpendicular to the axis of the shaft, said shelves forming the disk whose outer shape corresponds to the shape of the housing of the chamber, whereas the chamber is provided with holes coinciding with the slots in the slot-type exciter, and while the slot-type exciter itself is so positioned in relation to the chamber that in the course of operation it communicates with some of the compartments forming the working portion of the chamber.

3 Claims, 4 Drawing Figures

MICROWAVE OVEN HAVING IMPROVED CONVEYING MEANS

This is a continuation of application Ser. No. 484,221 filed June 28, 1974, now abandoned.

This Application discloses subject matter which is related to the disclosures in co-pending application Ser. No. 587,825 filed June 18, 1975 (which is a continuation of now-abandoned Application Ser. No. 481,845 filed June 21, 1974) and co-pending Application Ser. No. 601,480 filed Aug. 4, 1975 (which is a continuation of now-abandoned Application Ser. No. 481,884 filed June 21, 1974).

The present invention relates to thermal electric equipment, and more particularly to microwave-frequency food-stuff heating ovens which can be used at public catering establishments, and in the food and canning industry.

BACKGROUND OF THE INVENTION

Microwave-frequency ovens similar the type described herein, and primarily used for thermal treatment of food-stuffs, are known in the art.

One prior-art microwave-frequency oven comprises an microwave frequency electromagnetic oscillator connected through a slot-type exciter to a working chamber having a loading-unloading opening closed by a door. Installed inside the working chamber for the purpose of uniform heating of the product is a rotating frame carrying dielectric shelves onto which the products are placed for treatment.

A disadvantage of this known microwave-frequency cyclicaction oven is its low productivity, because loading and unloading of the products being treated require that the operation of the microwave-frequency oven be discontinued for that purpose, yet without switching off the oven it is impossible to prevent dissipation of microwave-frequency energy from the working chamber.

In addition, due to the short-time duration of the thermal treatment process, and the inconvenient loading and unloading of the products being treated, the oven utilization factor, i.e., ratio of the duration of thermal treatment versus the duration of the entire cycle (loading — thermal treatment — unloading) is very low. Because of the cyclic mode of operation of the microwave frequency electromagnetic oscillator, the service life of the latter is considerably reduced.

The food-stuff thermal treatment process even under optimum conditions is also made more difficult.

Also known are microwave-frequency continuous-action ovens comprising a conveying device taking the form of a continuous band, or a chain to carry the products being treated. In order to prevent dissipation of microwave-frequency energy into the environmental space, these microwave-frequency ovens are provided with cut-off attenuators positioned at the conveying device inlet to, and the outlet from the working zone.

A disadvantage of this known microwave-frequency continuous oven is associated with its large size, and its use of a relatively large amount of metal to manufacture, as well as the unreliable operation of the cut-off attentuators with the resultant dissipation of microwave-frequency energy into the environmental space. Besides, in these microwave-frequency ovens, the sanitation of the conveying device carrying the product in the course of thermal treatment is rather difficult.

SUMMARY OF THE INVENTION

The general object of the present invention is to obviate the above disadvantages.

Another object of the present invention is to provide an microwave continuous oven which would feature high productivity, and small size, and which is able to ensure the required thermal-treating conditions, and the higher performance characteristics, due to the improved design of the conveying device.

These objects are achieved by the provision of a microwave-frequency continuous oven primarily for heating foodstuffs, comprising a microwave-frequency electromagnetic oscillator connected through a slot-type electromagnetic exciter to a chamber shaped as a body for revolution with holes coinciding with slots in the slot-type exciter, and with a loading-unloading opening, while a rotor with shelves for the product is installed inside the chamber in coaxial relationship therewith, and according to the invention, the rotor shaft carries radially and equidistantly spaced blades whose outer contour corresponds to the shape of the housing of the chamber, and which divide the chamber into isolated compartments, whereas between the lower and upper edges of the blades, and perpendicular to the axis of the shaft, shelves made of a dielectric material are positioned, which together form a disk whose outer shape corresponds to the shape of the housing of the chamber, and the slot-type exciter is so located in relation to the chamber that in the course of operation it communicates with a number of the isolated compartments forming a working portion of the chamber, while the edges of the blades are provided with seals to prevent the dissipation of the microwave-frequency energy.

For uniform heating of the product it is expedient to provide each of the shelves with a carrier to be so positioned that, when passing through the working portion of the chamber, the carrier rotates in a horizontal plane around its own axis.

In order to protect the microwave-frequency electromagnetic oscillator against overload when the working portion of the chamber is free of the product, the rotor shaft should be hollow and made of a current-conducting material with holes closed by stoppers in the dielectric material, and filled with a material, such as running water, capable of the absorbing microwave-frequency electromagnetic energy.

The new arrangement for the microwave frequency oven proposed herein allows for the attainment of high productivity in a very compact design due to the cooperation of the components thereof.

The proposed microwave frequency oven affords a continuous thermal treating process under optimum operating conditions.

The fact that the points of loading and unloading the products treated in the microwave-frequency oven are combined together permits one operator to attend the oven in the operation, and if necessary allows the loading and unloading procedures to be automated, which also makes the oven applicable in automatic production lines.

The simple design makes repairs and mounting of the microwave-frequency oven easier, and sanitation the of the chamber more convenient.

The microwave-frequency oven of the instant invention due to its unique design concept requires 27-30 per cent less metal to manufacture, as compared with a conveyorized microwave-frequency oven having a similar productive capacity.

The protective devices between the edges of the rotor blades and the inner surface of the chamber, as well as the compartments provided in the oven, are designed to minimize the dissipation of the microwave-frequency energy through the loading-unloading opening into the environmental space.

The introduction of the microwave-frequency oscillation in the product treating compartments of the working portion of the chamber through th slots arranged in the chamber insures the required thermal conditions of the treating process to be assured by maintaining the preset level of oscillating power in each compartment.

BRIEF DESCRIPTION OF THE DRAWINGS

In order to make the present invention more readily understood a specific practical embodiment thereof will now be described in more detail with reference to the accompanying drawings, in which.

DESCRIPTION OF THE PREFERRED EMBODIMENT

Figure 2:
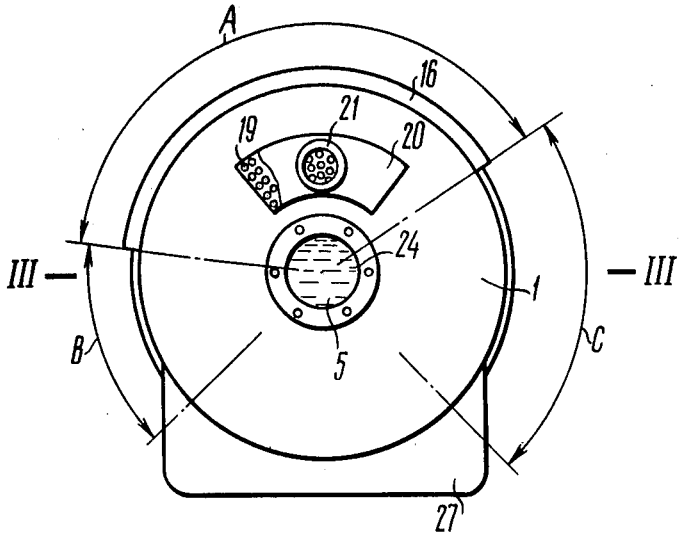
FIG. 2 is an general layout of an microwave-frequency oven (top view)

The microwave-frequency continuous oven (FIGS. 1 and 2) intended primarily for heating food-stuffs comprises a chamber 1 shaped as a body of revolution accommodating a rotor whose shaft 2 is provided with holes 3 closed by stoppers 4 made of a dielectric material.

The hollow shaft 2 is filled with a material 5, such as water, suitable for efficient absorption of an microwave-frequency electromagnetic energy. Running water can be used, if necessary.

Rigidly fixed to the hollow shaft 2 are blades 6 (FIG. 3) furnished over their perimeter with spring contact plates 7 used for sealing a gap between the blades 6 and the walls of the chamber 1. These plates perform the function of protective devices to prevent the dissipation of microwave-frequency electromagnetic energy. The blades 6 are shaped according to the generant of the chamber 1 along which they move, and divide the chamber 1 into isolated compartments. The chamber 1, the hollow shaft 2, and the blades 6 with the spring contact plates 7 are made of current-conducting material.

Shelves 8 (FIGS. 3 and 4) of dielectric material in the form of a circle sector are secured on said blades 6 between the upper and lower edges of the blades 6 perpendicular to the axis of the hollow shaft 2 of the rotor. Each shelf 8 mounts a carrier 9 for placement of the product 10 thereon for treatment which is either packed or in a special container 11.

Figure 3:
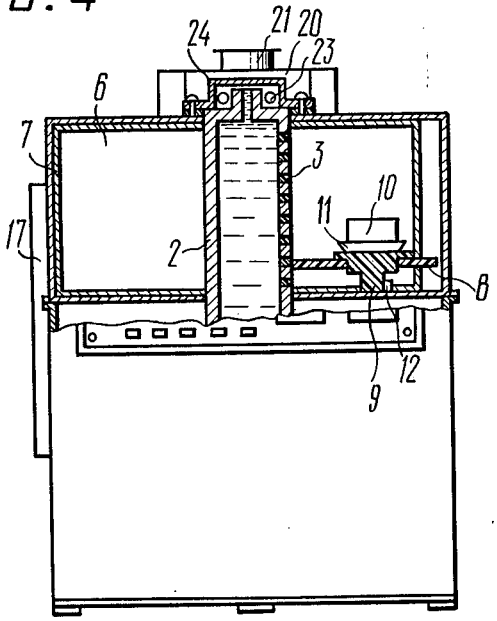
FIG. 3 is a sectional view taken along line III—III of FIG. 2.

Each carrier can rotate in a horizontal plane through a friction or gear drive 12 (FIG. 3).

Positioned in the lower portion of the microwave-frequency oven are the following microwave-frequency magnetron oscillator 13 (FIG. 1), a transformer unit 14, and a rectifier 15, with the latter two feeding the oscillator 13.

A slot type exciter 16, connected through a waveguide 17 to the microwave-frequency electromagnetic oscillator 13, encompasses a portion of the chamber 1, and, together with the rotor sectors found in that portion, forms a working portion A (FIGS. 2 and 4) of the chamber 1, with the latter portion having slots 18 coinciding with the slots of the exciter 16.

Ventilation of the working portion A of the chamber 1 is effected through cut-off attenuators 19 installed above the chamber in a shroud 20 having a pipe connection 21 to expel vapor produced during the thermal treatment of products.

A loading-unloading opening 22 is provided in the front portion of the microwave-frequency oven.

The hollow shaft 2 of the rotor is held in bearings 23, with the upper one being covered by a cap 24. The hollow shaft 2 is driven for rotation from an electric motor 26 through a gear reducer 25.

A table 27 (FIG. 2) and a control panel 28 (FIG. 1) with starting, controlling and indicating instruments are mounted in the middle portion of the face of the microwave-frequency oven.

The microwave-frequency oven operates as follows:

The electric motor 26 (FIG. 4), when switched on, rotates the rotor of the microwave-frequency oven, with its rotational speed being variable, depending on the dielectric properties of the products treated, by changing the rotational speed of the electric motor 26, or by altering the gear ratio of the reducer 25.

Figure 1:
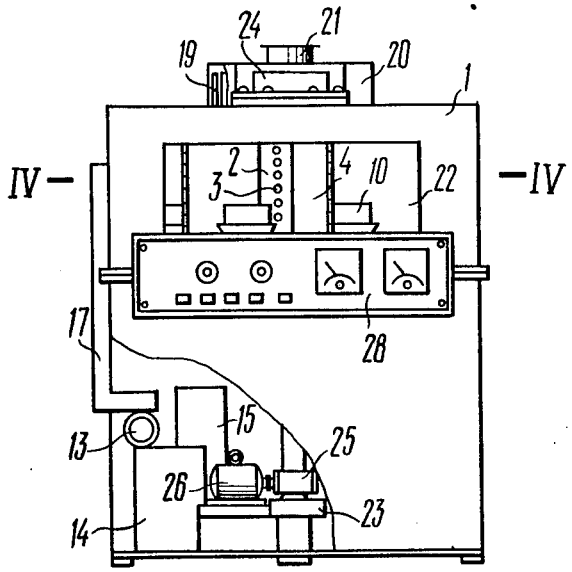
FIG. 1 is an general layout of an microwave-frequency oven (front view)
Figure 4:
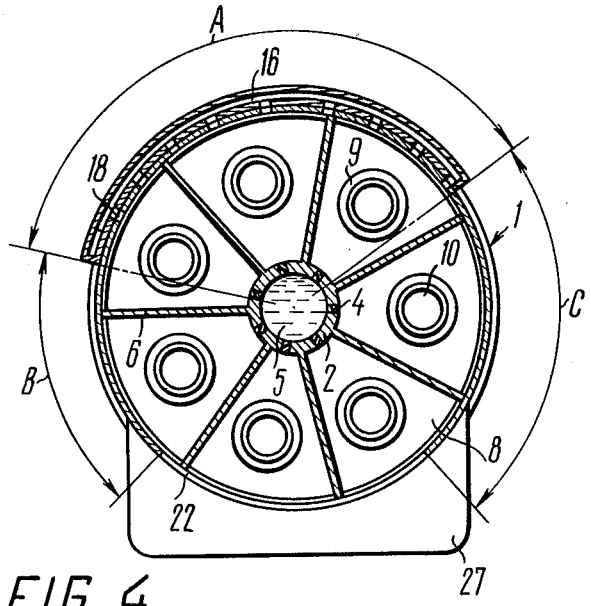
FIG. 4 is a sectional view taken along line IV—IV of FIG. 1.

The product 10 in the container 11 (FIG. 3) is manually or automatically placed onto the carriers 9 and fixed on the shelves 8 through the loading-unloading opening 22 (FIGS. 1 and 4). The inner space of the chamber 1 of the microwave-frequency oven is divided into isolated compartments formed by the blades 6 (FIG. 4) of the rotor, and the inner surface of the chamber 1.

The product 10 (FIG. 4), loaded into a rotor compartment, moves clockwise during rotation of the rotor, passes through the inlet locking zone B (FIGS. 2, and 4) and enters the working portion A of the chamber of the microwave-frequency oven, with said portion consisting of compartments encompassed by the slot-type exciter 16.

The working portion A of the chamber 1 is excited through the slot-type exciter 16, with the required power level in each compartment of the working portion A of the chamber 1 being achieved by providing the corresponding number and layout of the slots 18.

The microwave-frequency electromagnetic oscillator 13 (FIG. 1) operating with continuous duty, is power-supplied through the transformer unit 14, and the rectifier 15.

In the course of thermal treatment the product 10 (FIG. 3), during rotation of the rotor, is transferred from the inlet locking zone B of the chamber 1 to the working portion A of the chamber 1 (FIG. 4), then brought to the outlet locking zone C, and moved to the loading-unloading opening 22 where it is unloaded onto the table 27.

If, upon actuation of the microwave-frequency electromagnetic oscillator 13, the working portion A of the chamber 1 comes to contain no product 10, the microwave-frequency electromagnetic energy will dissipate in the absorbing material 5 when passing through the dielectric stoppers 4.

The vapors resulting from the thermal treatment of the product 10, are positively expelled from the working portion A of the chamber through the cut-off attenuators 19 (FIG. 2), the shroud 20, and the pipe connection 21.

For more uniform heating of the product 10 (FIG. 3), the carriers 9 are brought into rotation by means of the friction, or gear drive 12 when the compartments with the product 10 are passing through the working portion A of the chamber 1.

Dissipation of microwave-frequency energy from the chamber 1 through the loading-unloading opening 22 (FIG. 1) is prevented by the provision of a permanent electric contact between the spring contact plates 7 fixed over the periphery of the blades 6 (FIG. 4) and the inner surface of the housing, and the inlet and outlet locking zones B and C before and after the working portion A of the chamber 1.

The contact system can be replaced with contactless quarter-wave traps secured on the peripheral side of the blades 6, which are perpendicular to their plane.

The starting, stopping, and operating controls of the microwave-frequency oven are performed from the panel 28 which, beside the starting, and protecting equipment, also contains instruments to indicate the position of the compartments in the chamber 1 of the microwave-frequency oven, rotational speed of the rotor, and also an hourmeter to record the time period operated by the microwave-frequency electromagnetic oscillator 13.

What we claim is:

1. A microwave frequency turntable-type continuous oven having a loading section and shielded cooking sections, comprising: a chamber shaped as a body of revolution with holes, and a loading-unloading opening; a rotor installed inside said chamber in coaxial relationship therewith; a shaft of said rotor carrying radially and equidistantly spaced blades corresponding to the shape of the housing of said chamber through which they move, and dividing said chamber into compartments; shelves of dielectric material positioned between the upper and lower edges of said blades perpendicular to the axis of said shaft, which together form a disk whose outer shape corresponds to the shape of the housing of said chamber; seals positioned on said blades to prevent dissipation of the microwave-frequency energy; a slot-type electromagnetic exciter so positioned in relation to said chamber that in the course of operation it communicates with some of said isolated compartments forming the working portion of said chamber, while said holes in the chamber coincide with the slots in said slot-type exciter.

2. The microwave-frequency oven as set forth in claim 1, wherein for uniform heating of the product each of the shelves is provided with a carrier so installed that when passing through the working portion of the chamber the carrier is rotated in a horizontal plane around its own axis.

3. The microwave-frequency ovens as set forth in claim 1, wherein in order to protect the microwave-frequency oscillator against overload, when there is no product in the working portion of the chamber, the rotor shaft is of a hollow design, and made of current-conducting material, having holes closed by stoppers of dielectric material, and which is filled with a material, such as running water, capable of absorbing electromagnetic energy.

* * * * *